US011825888B2

(12) United States Patent
Bednar et al.

(10) Patent No.: US 11,825,888 B2
(45) Date of Patent: Nov. 28, 2023

(54) HOODED AND ADJUSTABLE ADAPTIVE GARMENT

(71) Applicant: NIKE, Inc., Beaverton, OR (US)

(72) Inventors: Kevin Bednar, Portland, OR (US); Aaron Edwards, Beaverton, OR (US); Devon Frazier, Beaverton, OR (US); Michelle Haines, Portland, OR (US); Lena Pham, Portland, OR (US); Hilary Walker, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 50 days.

(21) Appl. No.: 16/988,207

(22) Filed: Aug. 7, 2020

(65) Prior Publication Data

US 2021/0037898 A1 Feb. 11, 2021

Related U.S. Application Data

(60) Provisional application No. 62/885,175, filed on Aug. 9, 2019.

(51) Int. Cl.

| | |
|---|---|
| ***A41D 13/12*** | (2006.01) |
| ***A41D 1/215*** | (2018.01) |
| ***A41D 27/20*** | (2006.01) |

(52) U.S. Cl.

CPC ..... *A41D 13/129* (2013.01); *A41D 1/215* (2018.01); *A41D 27/20* (2013.01); *A41D 2200/20* (2013.01); *A41D 2400/44* (2013.01)

(58) Field of Classification Search

CPC ..... A41D 3/00; A41D 1/215; A41D 13/129; A41D 2200/20; A41D 2400/44; A41D 23/00; A41D 2023/004

See application file for complete search history.

(56) References Cited

U.S. PATENT DOCUMENTS 1,399,523 A * 12/1921 Sable ..... A41D 23/00 2/203
1,489,046 A * 4/1924 Thompson ..... A41B 9/08 2/269

(Continued)

FOREIGN PATENT DOCUMENTS

CN 107048493 A 8/2017
CN 208228395 U 12/2018

(Continued)

OTHER PUBLICATIONS www.espacenet.com, English translation of publication: CN 107048493A, published on Aug. 18, 2017, Bibliographic data. (Year: 2017).*

(Continued)

*Primary Examiner* — Alissa L Hoey
(74) *Attorney, Agent, or Firm* — SHOOK, HARDY & BACON L.L.P.

(57) ABSTRACT

Methods and systems are provided for an adaptive article of clothing. In one example, the adaptive article of clothing may have a first front tail panel and a second front tail panel configured to overlap while wrapping at least partially around a front of a wearer in opposite directions in a first worn configuration and hang open in a second worn configuration. A top portion of at least one of the first front tail panel and the second front tail panel may be detachably coupled in a shoulder region of the adaptive article of clothing to enable access to the wearer while the adaptive article of clothing is worn in each of the first worn configuration and the second worn configuration.

9 Claims, 8 Drawing Sheets

(56) References Cited

U.S. PATENT DOCUMENTS 1,545,441 A * 7/1925 Newman ..... A41C 3/00 D2/707
1,812,791 A * 6/1931 Katz ..... A41B 13/08 2/80
2,247,272 A * 6/1941 Becher ..... A41D 23/00 D2/601
2,515,657 A * 7/1950 Mendl ..... A41D 3/00 2/84
2,527,224 A * 10/1950 Landy ..... A41D 27/202 2/253
2,574,716 A * 11/1951 Spatz ..... A41D 3/00 2/84
2,657,389 A * 11/1953 Gross ..... A41D 3/08 2/88
2,804,626 A * 9/1957 Rossiter ..... A41D 23/00 2/207
2,967,306 A * 1/1961 Fabanich ..... A41D 3/08 2/87
3,193,842 A * 7/1965 Bell ..... A41D 27/20 D2/857
3,260,292 A * 7/1966 Costello ..... A42B 1/006 383/902
4,064,562 A * 12/1977 Kenny ..... A42B 1/006 2/84
4,499,612 A * 2/1985 Koike ..... A41D 27/20 2/253
4,554,682 A * 11/1985 Hillquist ..... A41D 3/00 2/108
4,706,304 A * 11/1987 Jones ..... A41D 27/10 2/91
4,797,954 A * 1/1989 Williams ..... A41B 1/08 2/106
4,928,321 A * 5/1990 Dobson ..... A42B 1/048 D2/741
5,077,838 A * 1/1992 Senser ..... A41D 15/00 2/87
5,378,192 A * 1/1995 Darmante ..... A41C 3/02 450/58
5,611,086 A * 3/1997 Eggen ..... A41D 1/215 2/104
5,920,906 A * 7/1999 Good ..... A41D 27/18 2/93
5,946,726 A * 9/1999 Green ..... A41C 3/08 2/102
5,991,923 A * 11/1999 Maria ..... A41D 13/1236 2/114
6,059,633 A * 5/2000 Currier ..... A41C 3/08 450/11
6,065,156 A * 5/2000 Murphy ..... A41D 23/00 2/207
6,068,538 A * 5/2000 Alleyne ..... A41C 3/02 450/58
6,105,171 A * 8/2000 Niedermeyer ..... A41D 13/129 2/114
6,253,379 B1 * 7/2001 Collier ..... A41D 3/02 2/125
6,272,888 B1 * 8/2001 Fujita ..... D04B 1/102 2/80
6,282,718 B1 * 9/2001 Drakford ..... A41D 15/00 2/70
6,647,552 B1 11/2003 Hogan
6,665,878 B1 * 12/2003 Way ..... A41D 3/02 2/84
6,694,521 B1 * 2/2004 Hopkins ..... A41D 13/129 2/114
6,854,132 B1 * 2/2005 Polzin ..... A41C 3/08 2/104
7,107,629 B2 * 9/2006 Miros ..... A41D 13/0051 2/84
7,429,206 B2 * 9/2008 Perry ..... A41F 15/02 450/86
7,634,818 B1 * 12/2009 Trujillo ..... A41D 13/04 2/48
7,934,269 B1 5/2011 Lask et al.
8,075,366 B1 * 12/2011 Jaksic ..... A41C 3/08 2/105
8,302,214 B2 * 11/2012 McGrath ..... A41D 13/1245 2/114
8,359,666 B2 * 1/2013 Appel ..... A41D 13/1245 2/114
8,403,724 B1 * 3/2013 Chapin ..... A41D 10/00 450/32
8,533,867 B2 * 9/2013 Oprandi ..... A41D 13/1245 2/114
8,549,666 B2 * 10/2013 Gheneva ..... A41D 1/06 2/106
8,821,461 B2 * 9/2014 Kovensky ..... A61F 5/4408 2/48
9,027,164 B2 * 5/2015 Seiler ..... A41D 1/22 2/54
9,364,038 B2 * 6/2016 Barrett ..... A42B 1/048
9,402,430 B2 * 8/2016 Jensen ..... A47D 13/02
9,498,007 B2 * 11/2016 Rizk ..... A47D 15/006
D807,612 S * 1/2018 Bushby ..... D2/717
10,004,279 B2 * 6/2018 Carlton ..... A41D 31/185
10,092,045 B2 * 10/2018 Smith ..... A41D 15/00
10,159,290 B2 * 12/2018 Fowler ..... A42B 1/048
10,463,086 B2 * 11/2019 Brown ..... B60N 2/265
10,631,582 B2 * 4/2020 Brault ..... A47D 13/02
10,849,440 B2 * 12/2020 Pérez ..... A41B 1/00
11,019,861 B2 * 6/2021 Picot ..... A41D 13/129
11,278,071 B2 * 3/2022 Darmour ..... A41D 27/10
11,406,145 B2 * 8/2022 Gambon ..... A41D 13/1245
2004/0181844 A1 * 9/2004 Kim ..... A41D 3/02 2/93
2005/0050614 A1 * 3/2005 Leung ..... A45F 4/12 2/209.13
2006/0150298 A1 * 7/2006 Jones ..... A41D 27/208 2/93
2007/0245444 A1 10/2007 Brink
2007/0271675 A1 * 11/2007 Eraca ..... A41D 1/215 2/104
2008/0000006 A1 * 1/2008 Ochoa ..... A41D 13/1236 2/114
2008/0196139 A1 * 8/2008 Eng ..... A47G 9/068 2/80
2010/0293695 A1 * 11/2010 Falvey ..... A41D 27/08 2/243.1
2011/0004971 A1 * 1/2011 Benderradji ..... A42B 1/048 2/202
2012/0005803 A1 1/2012 Sagami
2012/0151658 A1 * 6/2012 Von Furstenberg ..... A41D 13/1236 2/311
2013/0185845 A1 * 7/2013 Decker ..... A41D 27/10 2/243.1
2013/0276202 A1 * 10/2013 Forbes ..... A41D 13/1236 2/114
2013/0291279 A1 * 11/2013 Jensen ..... A47D 13/02 2/69
2014/0031775 A1 * 1/2014 Criss ..... A61F 5/4408 604/355
2014/0273736 A1 * 9/2014 Seiler ..... A41D 15/007 450/30
2015/0020288 A1 1/2015 Picot
2015/0033451 A1 * 2/2015 Bradshaw ..... A41D 27/10 2/243.1
2015/0189923 A1 * 7/2015 Boonen ..... A41D 1/215 2/104
2015/0327612 A1 * 11/2015 Bublitz ..... A41D 15/005 2/202
2016/0366956 A1 12/2016 Robinson et al.
2017/0119076 A1 * 5/2017 Marji ..... A42B 1/048
2017/0135421 A1 * 5/2017 Treyger ..... A41D 27/10
2017/0181484 A1 * 6/2017 Ozbek ..... A47K 10/02
2018/0064180 A1 * 3/2018 Dickson ..... A41D 1/215
2018/0064190 A1 * 3/2018 Khan ..... A42B 1/048
2018/0070657 A1 3/2018 Carter

(56) References Cited

U.S. PATENT DOCUMENTS

| | | | | |
|---|---|---|---|---|
| 2018/0092417 | A1* | 4/2018 | Klar | A42B 1/041 |
| 2018/0116307 | A1 | 5/2018 | Barton | |
| 2018/0271190 | A1 | 9/2018 | Campbell | |
| 2018/0338554 | A1* | 11/2018 | Lee | A41D 1/02 |
| 2018/0343939 | A1* | 12/2018 | Goulet | A41D 13/129 |
| 2019/0000155 | A1* | 1/2019 | Saunders | A41D 3/00 |
| 2019/0110538 | A1* | 4/2019 | Ghasletwala | A41F 1/002 |
| 2019/0216231 | A1* | 7/2019 | Pérez Sanchez | A47D 13/025 |
| 2019/0239573 | A1* | 8/2019 | Mercy | A41B 13/06 |
| 2019/0261718 | A1* | 8/2019 | O'Connor | A41D 3/02 |
| 2019/0274367 | A1* | 9/2019 | Bolling | A41B 13/08 |
| 2020/0000156 | A1* | 1/2020 | Neuhaus | A41D 1/02 |
| 2020/0093198 | A1* | 3/2020 | Taylor | A41D 27/20 |
| 2020/0100551 | A1* | 4/2020 | Lee | A42B 1/048 |
| 2020/0154795 | A1* | 5/2020 | Valster | A41D 3/005 |
| 2020/0178625 | A1* | 6/2020 | Turand | A41D 3/02 |
| 2020/0383399 | A1* | 12/2020 | Rizk | A41D 3/00 |
| 2021/0037898 | A1* | 2/2021 | Bednar | A41D 1/215 |
| 2021/0204627 | A1* | 7/2021 | Linchitz | A41D 3/005 |
| 2021/0378319 | A1* | 12/2021 | Korte | A41D 1/215 |

FOREIGN PATENT DOCUMENTS

| | | | |
|---|---|---|---|
| JP | 3200971 | U | 11/2015 |
| KR | 10-2012-0001665 | A | 1/2012 |

OTHER PUBLICATIONS www.espacenet.com, English translation of publication: CN 107048493A, published on Aug. 18, 2017, Description. (Year: 2017).* www.espacenet.com, English translation of publication: CN 107048493A, published on Aug. 18, 2017, Claims. (Year: 2017).* www.espacenet.com, English translation of publication: CN 107048493A, published on Aug. 18, 2017, Drawings. (Year: 2017).*

International Search Report and Written Opinion received for PCT Patent Application No. PCT/US2020/045494, dated Oct. 22, 2020, 13 pages.

International Preliminary Report on Patentability received for PCT Patent Application No. PCT/US2020/045494, dated Feb. 17, 2022, 9 pages.

* cited by examiner

HOODED AND ADJUSTABLE ADAPTIVE GARMENT

CROSS REFERENCE TO RELATED APPLICATIONS

The present application claims priority to U.S. Provisional Application No. 62/885,175, entitled "HOOKED AND ADJUSTABLE ADAPTIVE GARMENT," and filed on Aug. 9, 2019. The entire contents of the above-identified application are hereby incorporated by reference for all purposes.

FIELD

The present description relates generally to methods and systems for an adaptive garment.

BACKGROUND

An apparel item may be worn over a torso of a wearer for warmth, comfort, and to carry objects that may be inserted into pockets of the apparel item. The apparel item may be configured to allow access to a shoulder and chest region of the wearer by adapting the apparel item with panels that may be adjusted between open and closed positions.

SUMMARY

Access to a wearer's torso may be demanded during processes such as medical treatment, breast-feeding, etc. It may be desirable to enable access to the wearer's torso without removing an article of clothing worn by the wearer. Furthermore, while medical treatment of the wearer is conducted, the wearer may rely on the article of clothing for warmth, coverage, and overall comfort. Additionally it may be desirable to provide the wearer with an article of clothing that may be donned without positioning the wearer's limbs and joints in positions causing discomfort, such as overhead.

In one example, an adaptive article of clothing includes a first front tail panel and a second front tail panel configured to overlap while wrapping at least partially around a front of a wearer in opposite directions in a first worn configuration and hang open in a second worn configuration, wherein a top portion of at least one of the first front tail panel and the second front tail panel is detachably coupled in a shoulder region of the adaptive article of clothing to enable access to the wearer while the adaptive article of clothing is worn in each of the first worn configuration and the second worn configuration. In this way, the wearer's torso may be accessed during various procedures without removing the adaptive article of clothing. The adaptive article of clothing may be adjusted to provide a desired amount of warmth and a swaddling effect to the wearer.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
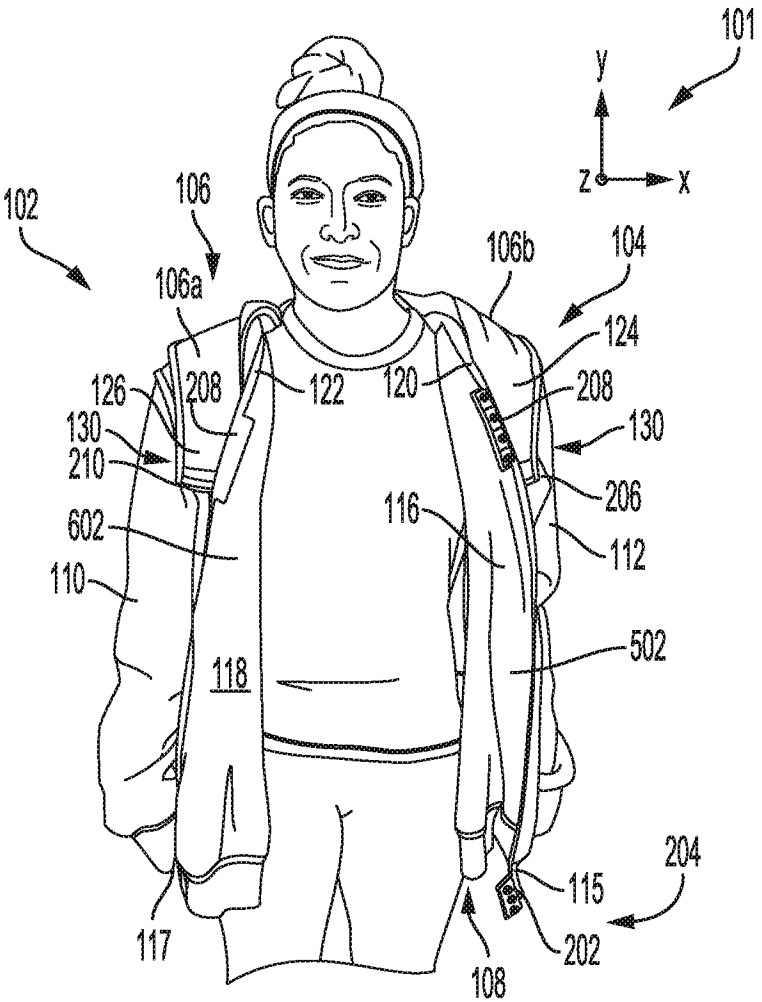
FIG. 2 shows a second front view of the adaptive article of clothing with the main body section in a second worn configuration and the hood positioned away from the head of the wearer and the neck flaps unfastened.
Figure 1:
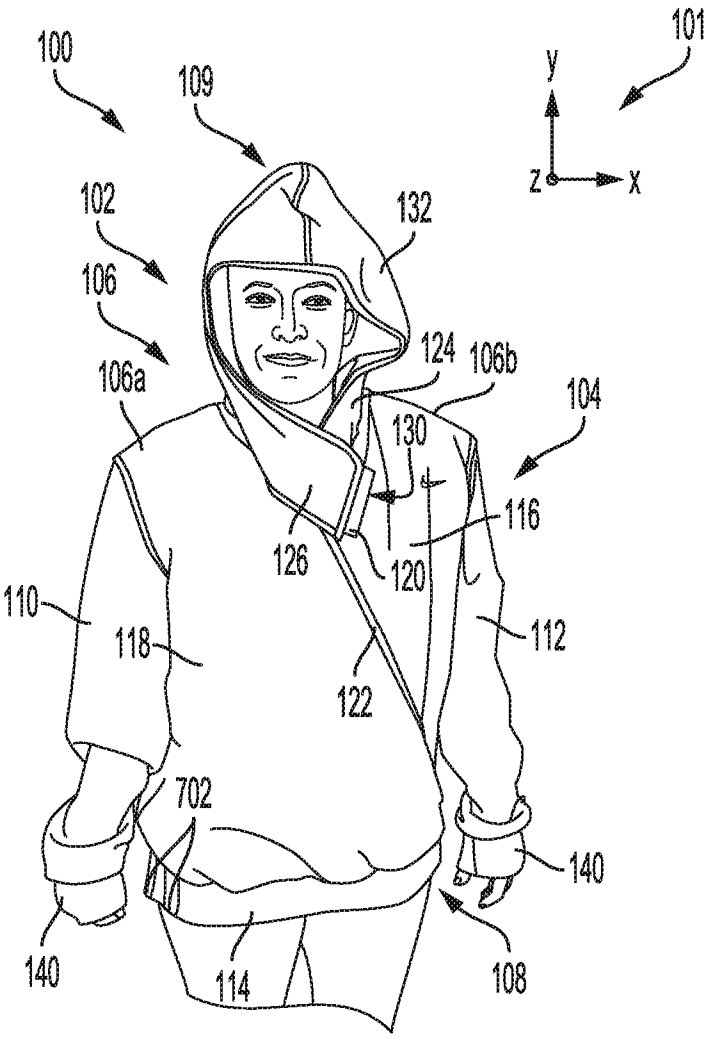
FIG. 1 shows a first front view of an adaptive article of clothing with a main body section of the article of clothing in a first worn configuration and a hood of the adaptive article of clothing covering a head of the wearer with neck flaps of the hood fastened, according to an embodiment.
Figure 7:
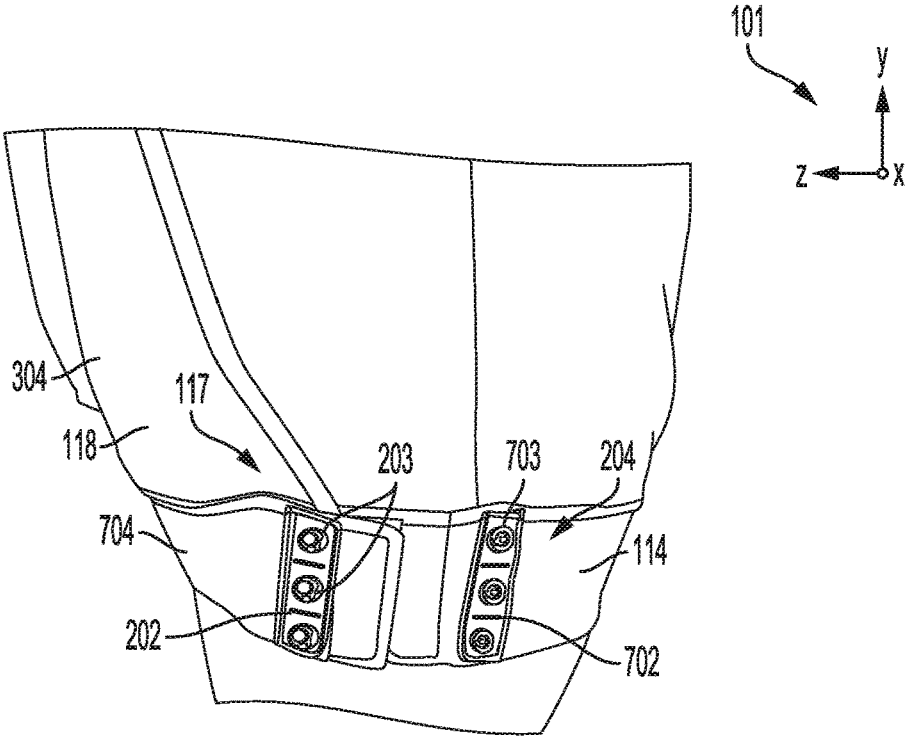
FIG. 7 shows a zoomed-in left-side view of a lower region of the main body section of the adaptive article of clothing.
Figure 8:
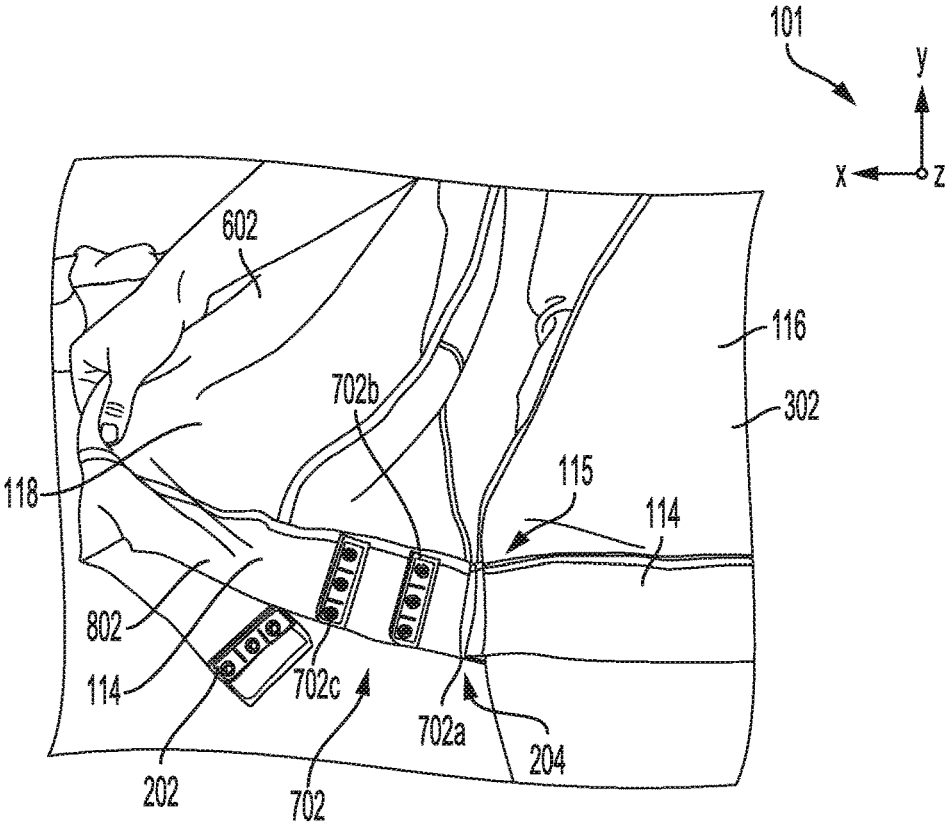
FIG. 8 shows a zoomed-in front view of a right-side of the main body section with the second front tail panel pulled away from the wearer.
Figure 9:
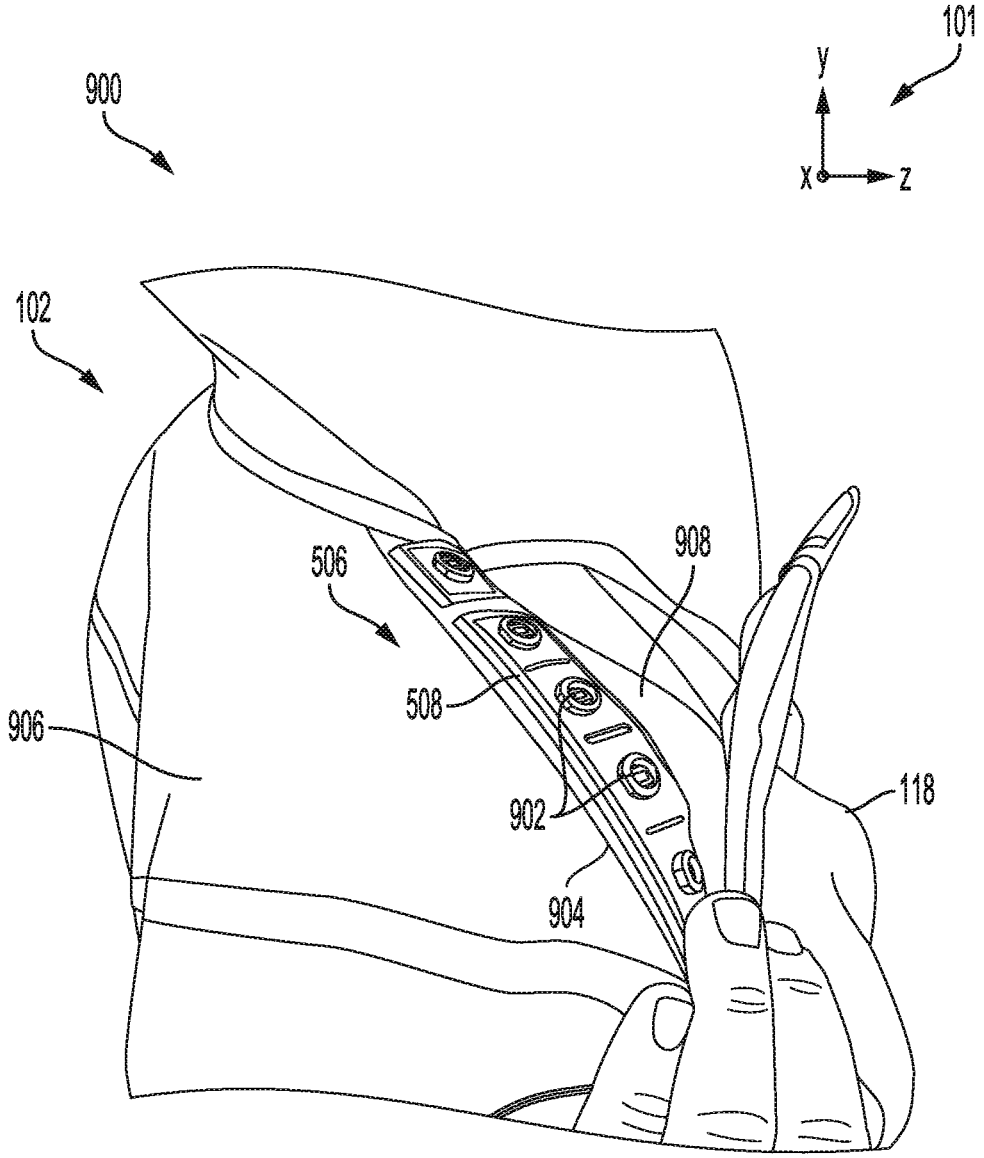
FIG. 9 shows a zoomed-in view of a fastening device at a shoulder region of the main body section of the adaptive article of clothing.
Figure 13:
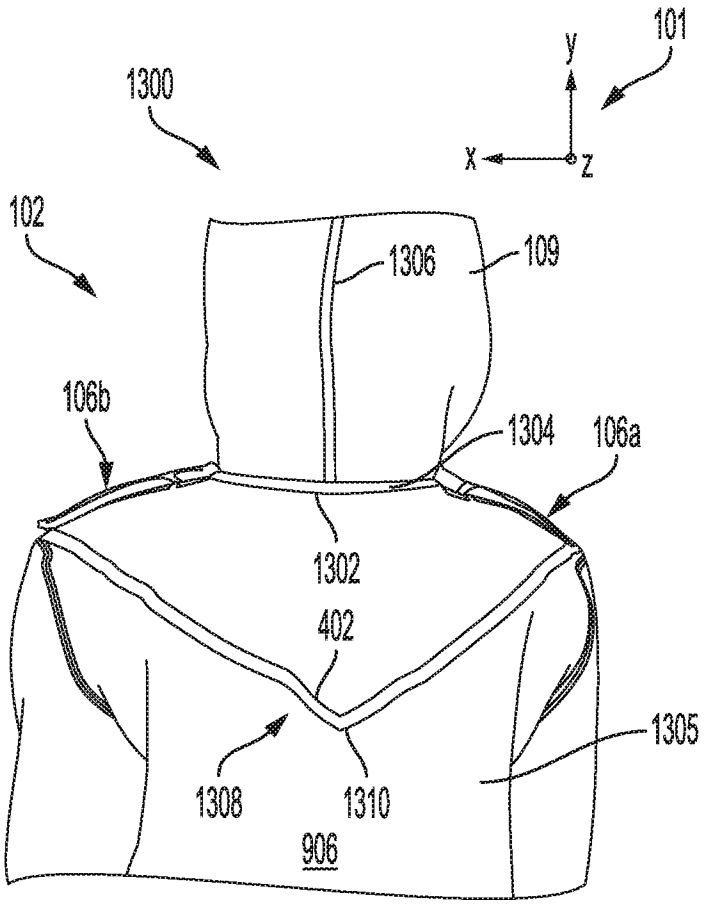
FIG. 13 shows a second rear view of the adaptive article of clothing with the hood covering the wearer's head.

An adaptive article of clothing is described herein. The adaptive article of clothing includes a first front tail panel and a second front tail panel configured to overlap with one another and wrap at least partially around a front of a wearer when a main body section of the adaptive article of clothing is worn in a first worn configuration, as shown in FIG. 1. A hood of the adaptive article of clothing, coupled to the main body section, may also be worn covering the wearer's head with a set of neck flaps fastened and covering the wearer's neck, as depicted in FIG. 1. In contrast, in a second worn configuration of the main body section, the first front tail panel and the second front tail panel may be spaced away from one another and hang down from the wearer's shoulders, as shown in FIG. 2. The hood is removed from the wearer's head with the set of neck flaps disengaged and hanging down along a front of the wearer. Various modifications to how the adaptive article of clothing may be worn are shown in FIGS. 3-6. Fastening devices may be used to enable an adjustability of the adaptive article at a hem and at shoulder regions of the adaptive article of clothing, as shown in FIGS. 7-9. The main body section of the adaptive article of clothing may include a first and a second inner panel, depicted in FIGS. 10 and 11, which may be equipped with pockets. The hood may be attached to an upper region of a back panel of the main body section of the adaptive article of clothing. Rear views of the adaptive article of clothing are provided in FIGS. 12 and 13, showing the hood pulled away from the wearer's head and covering the wearer's head, respectively. An example of a back of the adaptive article of clothing is shown separately, detached from all other pieces of the adaptive article of clothing in FIG. 14 and an example of a front tail panel of the adaptive article of clothing is similarly shown separately in FIG. 15.

FIGS. 1-13 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

An article of clothing, or garment, may provide warmth and coverage to a wearer during events such as breastfeeding and chemotherapy, for example. In such instances, access to the wearer's torso without removing the garment may provide the wearer with a sense of comfort and also an amount of warmth both of which may be adjusted by varying how the garment is worn. In some examples, the wearer's mobility may be restricted, impeding an ability of the wearer to pull the garment on or off over the wearer's head. As such, it may be additionally desirable to provide a garment which may be worn without extension of the wearer's arms away from the wearer's body.

The issues described above may be at least partially addressed by an adaptive article of clothing having a first front tail panel and a second front tail panel configured to overlap while wrapping at least partially around a front of a wearer in opposite directions in a first worn configuration and hang open in a second worn configuration, and wherein a top portion of at least one of the first front tail panel and the second front tail panel is detachably coupled in a shoulder region of the adaptive article of clothing to enable access to the wearer while the adaptive article is worn in each of the first worn configuration and second worn configuration. The adaptive article of clothing may further include a hood attached to an upper region of a back panel of the adaptive article of clothing. The hood may include adjustable flaps configured to cover a neck of the wearer when ends of the flaps are coupled to upper areas of the first and second front tail panels.

The adaptive article of clothing, or garment, may be formed of a soft, elastic material to minimize irritation to the wearer's skin and may include seams connecting panels of the garment to one another that do not protrude. The garment therefore may be free of any ridges or fabric edges that may cause a component of a medical object, such as a catheter line, to catch on an exterior surface or an interior surface of the garment. Furthermore, the garment may be donned and removed without demanding sweeping arm motions or upward extension of the wearer's arms above the wearer's head. An ease of entry of the garment may be further supplemented by configuring the garment with fastening devices that may be opened and closed with minimal effort, e.g., by simply bringing two halves of the fastening devices in contact with one another to close the fastening devices and gently tugging the two halves apart to open the fastening devices.

In some examples, the wrapping of the garment, at least partially around the front of the wearer, similar to a kimono, may offer the wearer a swaddling effect that may provide warmth and comfort. The swaddling effect may be adjusted by selectively engaging a first half of a fastening device with a plurality of discs of a second half of the fastening device, where placement of the plurality of discs of the second half of the fastening device enables variation in a tightness of the garment around the wearer. For example, the first half of the fastening device may be arranged on a front tail panel of the garment and each of the plurality of discs of the second half of the fastening device may be arranged in parallel and spaced apart along a hem of the garment. Thus, the wearer may choose one of the plurality of discs of the second half according to a desired tightness of the garment at a target region of the garment, where the target region may be determined by the location of the fastening device. In one example, a comfort of the wearer may be maintained and/or increased while undergoing an event such as nursing or medical procedure, etc.

Turning now to FIG. 1, a garment 102 is shown in a first front view 100 in a first worn configuration, e.g., a first configuration. In the first worn position shown in FIG. 1, the garment 102 may be in a closed arrangement where a first front tail panel 116 wraps across the front of a wearer in a first direction, e.g., from the wearer's left side to the wearer's right side, and a second front tail panel 118 wraps across the front of the wearer in a second, opposite direction, e.g., from the wearer's right side to the wearer's left side. The closed arrangement of the first worn configuration decreases an amount of the wearer's torso that is not covered by the garment 102. Furthermore, the first worn configuration fastens the ends of the front tail panels so that no regions of the garment 102 are swinging/dangling along a main body section 104 of the garment 102. Both the first front tail panel 116 and the second front tail panel 118 are secured in place, e.g., wrapped around the front of the wearer, by a first set of fastening devices located at the left side and the right side of the wearer, along a hem 114 of the garment 102. The first set of fastening devices may be configured to allow the wearer to choose a coupling of two halves of each of the first set of fastening devices according to a desired tightness of the garment 102 around the wearer at a hip region 108. A second set of fastening devices may be positioned at top portions of the each of the first and second front tail panels 116, 118, enabling selectively coupling and decoupled of the top portions of the front tail panels at a shoulder region 106 of the garment 102 when the garment 102 is in the first worn configuration. Details of the fastening devices are described further below.

A set of reference axes 101 is provided for comparison between views shown in FIGS. 1-13, including a y-axis, an x-axis, and a z-axis. In some examples, the y-axis may be parallel with a direction of gravity, the x-axis may be parallel with a horizontal direction, and the z-axis is perpendicular to both the y-axis and the z-axis. The garment 102 may be worn around a torso of the wearer and includes the main body section 104, extending along the y-axis from the shoulder region 106 to the hip region 108 of the wearer. The shoulder region 106 includes a first, or right, shoulder region 106*a* and a second, or left, shoulder region 106*b*. The garment 102 also has a hood 109 arranged above the main body section 104 and configured to cover a head of the wearer when worn in the first worn configuration as shown in FIG. 1.

The main body section 104 has a first sleeve 110 through which the wearer's right arm may be inserted, and a second sleeve 112 through which the wearer's left arm may be inserted. Each of the first sleeve 110 and the second sleeve 112 may be attached to a back panel of the main body section 104 of the garment 102. The back panel is discussed further below with reference to FIGS. 9 and 12-14. The main body section 104 also has a hem 114 which defines a bottom edge of the garment 102 and circumferentially surrounds the hip region 108 of the wearer when the garment 102 is worn in the first worn configuration shown in FIG. 1. The hem 114 may be configured to be more elastic than a material of other regions of the garment 102 so that the hem 114 surrounds the wearer more snugly than regions of the garment above the hem 114.

The garment 102 is adapted to wrap around at least a front of the wearer by configuring the main body section 104 of the garment 102 with the first front tail panel 116 and second front tail panel 118. Each the first front tail panel 116 and the second front tail panel 118 may be tapered sections, narrowing as each panel extends away from side edges of the back panel along the x-axis. In other words, the tapering of the front tail panels may include a decrease in a height of the front tail panels, the height defined along the y-axis, as a distance away from the back panel increases. The height may decrease due to a slanting of an upper edge of each of the front tail panels, e.g., the upper edge is angled relative to the x-axis, while a bottom edge of each of the front tail panels may be parallel with the x-axis.

In some examples, the first and second front tail panels 116, 118 may narrow along the y-axis so that distal ends of each of the front tail panels are 5-20% of a height of each of the front tail panels at intersections of each front tail panel with the back panel. In other examples, as shown by the garment 102 in FIGS. 1, 3, and 15, the first and second front tail panels 116, 118 may taper to a point to form triangular portions of each of the front tail panels.

The garment 102 is shown in FIG. 1 with the second front tail panel 118 overlapping with the first front tail panel 116 so that the first front tail panel 116 is between the second front tail panel 118 and the wearer. The first front tail panel 116 has a first inner edge 120 and the second front tail panel 118 has a second inner edge 122. The first inner edge 120 and the second inner edge 122 extend diagonally across the front of the wearer in opposite directions. For example, the first inner edge 120 may extend from the second shoulder region 106*b* to a right-side of the hip region 108 and the second inner edge 122 may extend from the first shoulder region 106*a* to a left-side of the hip region 108. Stated another way, the first inner edge 120 tapers towards a longer bottom edge of the first front tail panel 116 to define a taper of the first front tail panel 116.

Figure 14:
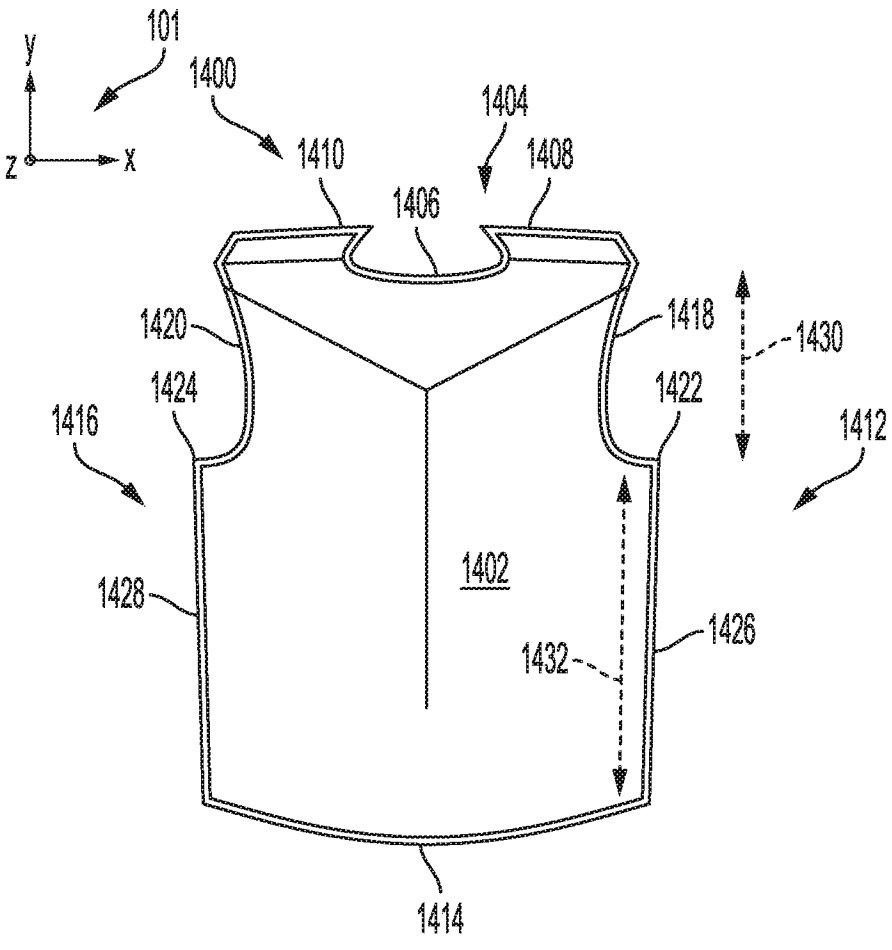
FIG. 14 shows an example of a back panel which may be included in an adaptive article of clothing.

As described above, at least a portion of each of the first front tail panel 116 and the second front tail panel 118 may be triangular in shape. The first front tail panel 116 may be attached to a first side of a back panel, or back section, of the garment 102 and the second front tail panel may be attached to a second, opposite side of the back panel of the garment 102. An example of a back panel 1400 of the garment 102 is shown in FIG. 14. The back panel 1400 may cover a back side of a wearer and may be depicted in FIG. 14 with an inner surface 1402 facing forwards, e.g., out of the page. The back panel 1400 may be formed of a single, continuous piece of fabric and form a base of the garment 102 to which all other sections and panels are attached. An overall shape of the back panel 1400 may accommodate a shape of the wearer's torso, covering the wearer's back and providing a sufficient amount of slack in the fabric to allow movement.

The back panel 1400 has an upper edge 1404 which may include a collar 1406, configured to partially surround a neck of the wearer, a first shoulder flap 1408, and a second shoulder flap 1410. The first shoulder flap 1408 may be placed over a left shoulder of the wearer, e.g., the second shoulder region 106*b*, and the second shoulder flap 1410 may be placed over a right shoulder of the wearer, e.g., the first shoulder region 106*a*.

A first side edge 1412 of the back panel 1400 may extend along a left side of the back panel 1400, between the upper edge 1404 and a bottom edge 1414 of the back panel 1400. A second side edge 1416 may extend between the upper edge 1404 and the bottom edge 1414 along a right side of the back panel 1400. The first side edge 1412 and the second side edge 1416 may be perpendicular to the upper edge 1404 of the back panel 1400. The bottom edge 1414 of the back panel 1400 may be curved and may couple to a hem, such as the hem 114 of FIG. 1, via stitching, for example. A left sleeve, such as the second sleeve 112 of FIG. 1, may be coupled to an upper curved portion 1418 of the first side edge 1412 and a right sleeve, such as the first sleeve 110 of FIG. 1, may be coupled to an upper curved portion 1420 of the second side edge 1416. The upper curved portion 1418 of the first side edge 1412 extends from the first shoulder flap 1408 to a first mid-point 1422 between the first shoulder flap 1408 and the bottom edge 1414. The upper curved portion 1420 of the second side edge 1416 extends from the second shoulder flap 1410 to a second mid-point 1424 between the second shoulder flap 1410 and the bottom edge 1414.

Figure 15:
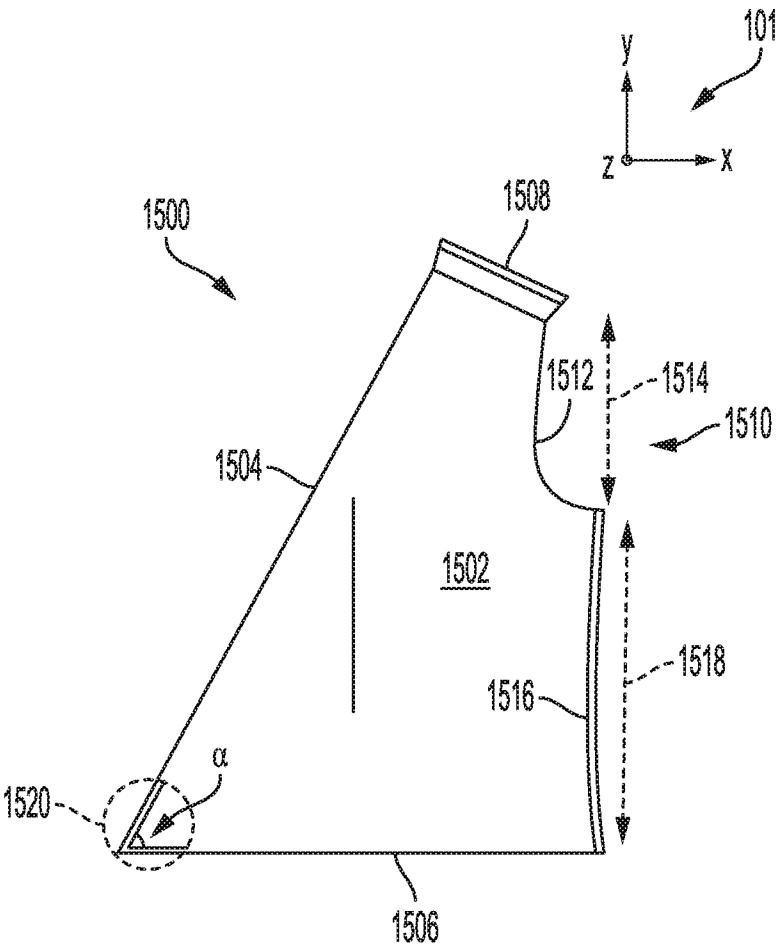
FIG. 15 shows an example of a front tail panel which may be included in an adaptive article of clothing.

The first side edge 1412 has a linear portion 1426 extending from the first mid-point 1422 of the first side edge 1412 to the bottom edge 1414 of the back panel 1400 and the second side edge 1416 has a linear portion 1428 extending from the second mid-point 1424 of the second side edge 1416 to the bottom edge 1414. The linear portion 1426 of the first side edge 1412 may be attached to an edge of a front tail panel of a garment, e.g., the garment 102 of FIGS. 1-13. An example of a front tail panel 1500 is shown in FIG. 15. In one example, the front tail panel 1500 may be a non-limiting example of the first front tail panel 116 of FIG. 1. The second front tail panel 118 of FIG. 1 may therefore be similar to a mirror-image of the front tail panel 1500 of FIG. 15. The front tail panel 1500 is shown in FIG. 15 with an outer surface 1502 of the front tail panel 1500 facing out of the page.

The front tail panel 1500 may be a tapered section of a garment, having an overall triangular geometry with an inner edge 1504, a bottom edge 1506, a top edge 1508 and a side edge 1510. An intersection of the inner edge 1504 and the bottom edge 1506 may form an acute angle α. In one example, a may be 55 degrees. In other examples, the angle α may be an angle between 30-70 degrees. The bottom edge 1506 may be coupled to a hem with stitching, the hem also coupled to the back panel 1400, such as the hem 114 of FIG. 1. The inner edge 1504 does not couple to any other panels of garment, instead configured to extend across a front side of the wearer, as shown in FIG. 1, when worn in the first worn configuration. The side edge 1510 of the may have a similar shape to the first side edge 1412 of the back panel. For example, an upper curved portion 1512 may have a similar curvature and length 1514 to a curvature and a length 1430 of the upper curved portion 1418 of the first side edge 1412 of the back panel 1400. A lower portion 1516 of the side edge 1510 of the front tail panel 1500 may have a length 1518 similar to a length 1432 of the linear portion 1426 of the first side edge 1412 of the back panel 1400. As such, the linear portion 1426 of the first side edge 1412 of the back panel 1400 may be directly coupled to the lower portion 1516 of the side edge 1510 of the front tail panel 1500 via stitching, for example, in a direction parallel with the y-axis to form a seam.

The seam may be stitched so that the joining of the first side edge 1412 of the back panel 1400 with the lower portion 1516 of the side edge 1510 of the front tail panel 1500 does not result in protrusion of the seam outwards, away from the wearer, or inwards, towards the wearer. For example, the seam may be a lapped seam, a bound seam, or a flat seam. Furthermore, other seams joining sections of the garment 102 shown in FIGS. 1-13 may incorporate such stitching so that outer surfaces, e.g., surfaces facing away from the wearer, and inner surfaces, e.g., surfaces facing towards the wearer, do not include any protruding fabric edges that may engage undesirably with external objects, such as medical devices and lines.

The first side edge 1412 of the back panel 1400 may be unremovably coupled to the lower portion 1516 of the side edge 1510 of the front tail panel 1500. In contrast, the top edge 1508 of the front tail panel 1500 may be removably coupled to the first shoulder flap 1408 of the back panel 1400. For example, the top edge 1508 of the front tail panel 1500 may have a first half of a fastening device attached to an inner surface, opposite of the outer surface 1502 of the front tail panel 1500. An example of a first half of a fastening device is shown in FIG. 5 in a fourth front view 500 of the garment 102.

Figure 5:
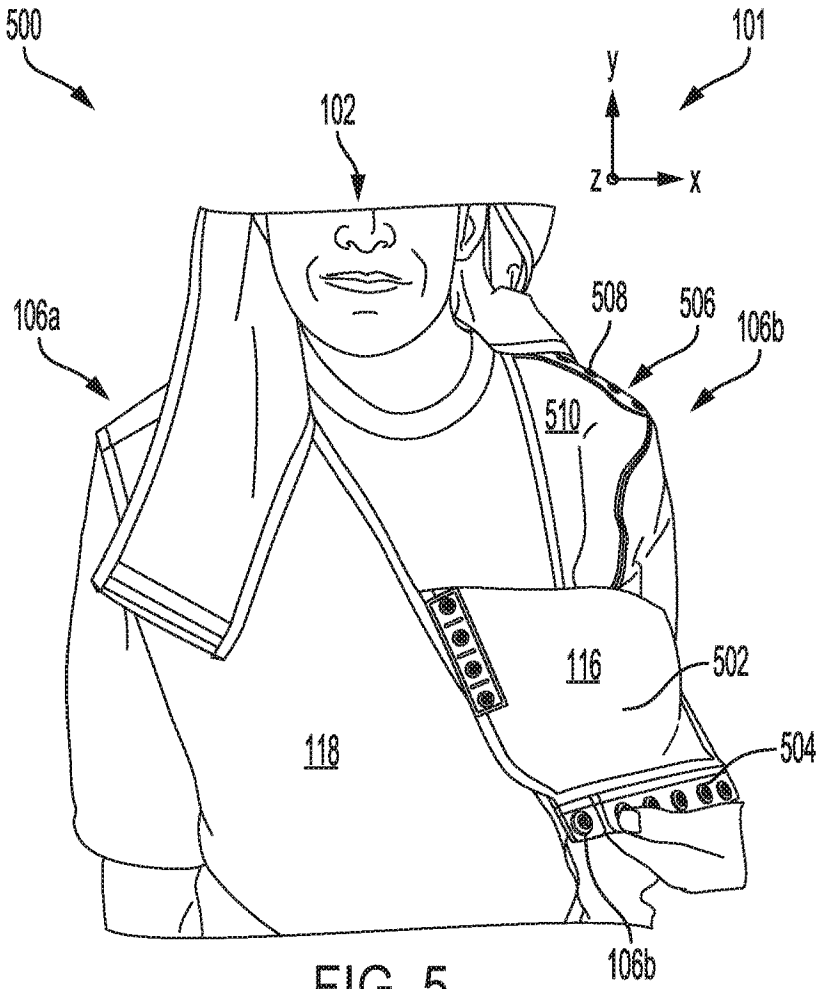
FIG. 5 shows a fourth front view of the adaptive article of clothing with a first front tail panel of the adaptive article of clothing detached from a shoulder region of the adaptive article of clothing.

As shown in FIG. 5, the first front tail panel 116 has an inner surface 502 with a first half 504 of a first fastening device 506 fixedly attached to the inner surface 502. The first half 504 of the first fastening device 506 forms a relatively narrow strip along the inner surface 502, extending across the left shoulder region 106*b* of the garment 102. The first half 504 of the first fastening device 506 may be configured to engage with a second half 508 of the first fastening device 506. A zoomed-in view 900 of the second half 508 of the first fastening device 506 is shown in FIG. 9. The second half 508 of the first fastening device 506 includes a plurality of discs 902 arranged along a right shoulder seam 904 of the garment 102. The plurality of discs 902 may be a mechanism for fastening the first fastening device 506. The second half 508 of the first fastening device 506 may be similarly arranged along a left shoulder seam 904 of the garment 102 and along an outer surface of a second inner panel 908 of the garment 102, the second inner panel 908 attached to a back panel 906 of the garment. The back panel 906 shown in FIG. 9 may be similar to the back panel 1400 of FIG. 14. The second inner panel 908 of the garment 102 is described further below.

The plurality of discs 902 of the second half 508 of the first fastening device 506 are configured to mate with the first half 504 of the first fastening device 506, as shown in FIG. 5. The first half 504 of the first fastening device 506 may also include a mechanism for fastening the first fastening device 506, such as a plurality of discs, each disc of the plurality of discs similarly spaced apart as the plurality of discs 902 of the second half 508. Thus the first half 504 of the first fastening device 506 may engage with the plurality of discs 902 of the second half 508 of the first fastening device 506 so that the first half 504 and the second half 508 are coupled, thereby attaching the first front tail panel 116 to a left shoulder seam 512 of the garment 102. The left shoulder seam 512 attaches the back panel 906 (as shown in FIG. 9) to the first inner panel 510 of the garment 102.

As one example, the first half 504 and the second half 508 of the first fastening device 506 may be magnetic. In another example, the first fastening device 506 may be a snap button closure. Various other type of fastening mechanisms enabling separation of the halves of the first fastening device 506 by application of a small amount of force may be implemented without departing from the scope of the present disclosure. In other words, any type of fastening device may be used which allows the first half 504 to be readily attached to and detached from the second half 508 with minimal application of pressure.

Figure 6:
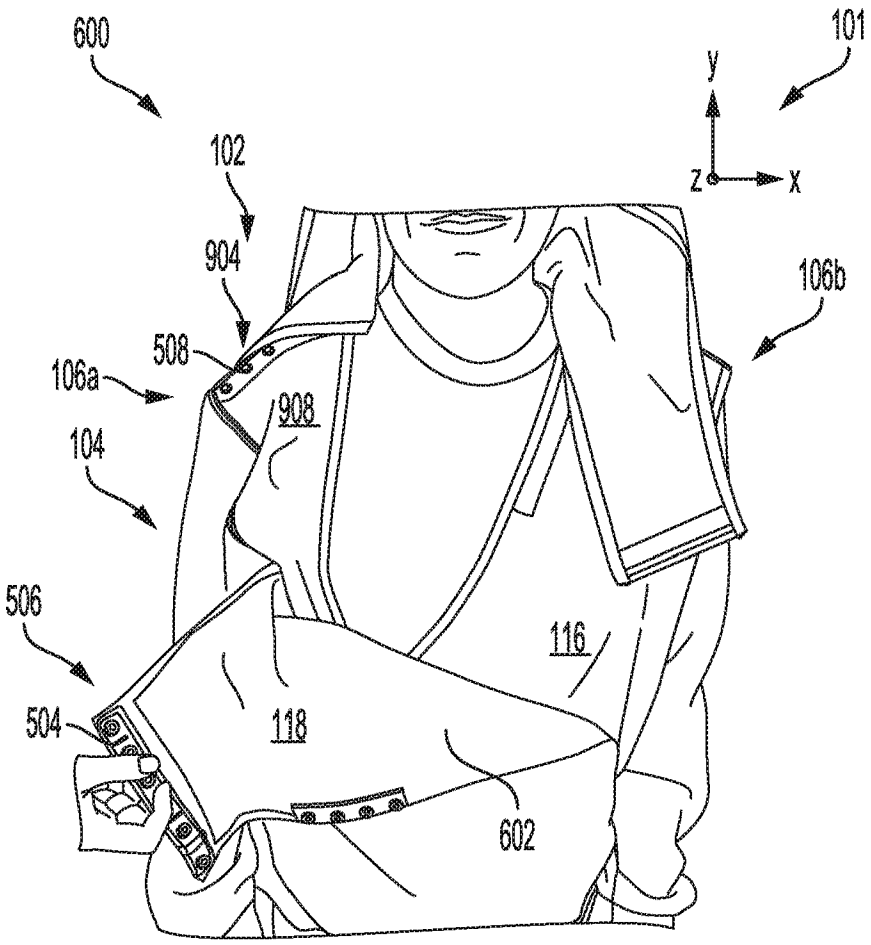
FIG. 6 shows a fifth front view of the adaptive article of clothing with a second front tail panel of the adaptive article of clothing detached from the shoulder region of the adaptive article of clothing.

As shown in a fifth front view 600 in FIG. 6, the second front tail panel 118 may be similarly configured with the first half 504 of the first fastening device 506 at an inner surface 602 of second front tail panel 118 and the first half 504 of the first fastening device 506 at the right shoulder seam 904. By engaging the first half 504 with the second half 508 of the first fastening device 506 at the shoulder region 106 of the main body section 104 of the garment 102, the garment 102 may be maintained in the first worn configuration shown in FIG. 1.

Maintaining the garment 102 in the first worn configuration may also include fastening a first end 115 of the first front tail panel 116 to a point along the hem 114 at the right side of the wearer and fastening a second end 117 of the second front tail panel 118 to a point along the hem 114 at the left side of the wearer. The first end 115 of the first front tail panel 116 and the second end 117 of the second front tail panel 118 are shown in a second front view 200 of the garment 102 in FIG. 2. The first end 115 of the first front tail panel 116 may be the region indicated by dashed circle 1520 in FIG. 15, where the inner edge 1504 and the bottom edge 1506 of the front tail panel 1500 intersect and may include a portion of the hem 114 of the garment 102. The second end 117 of the second front tail panel 118 may be an analogous region of the second front tail panel 118 as indicated by dashed circle 1520.

The garment is shown in a second worn configuration, or second configuration, in FIG. 2. In the second worn configuration, the first end 115 of the first front tail panel 116 and the second end 117 of the second front tail panel 118 are detached from the hem 114 of the garment 102. As such, the front tail panels hang open along the front of the wearer, spaced apart and draping from the shoulder region 106 of the garment 102. The upper edges of the front tail panels may be either attached or detached at the shoulder region 106 of the garment 102. In other words, fastening devices at the shoulder region 106 of the garment 102 may be selectively engaged or disengaged when the garment is worn in the second worn configuration.

Figure 3:
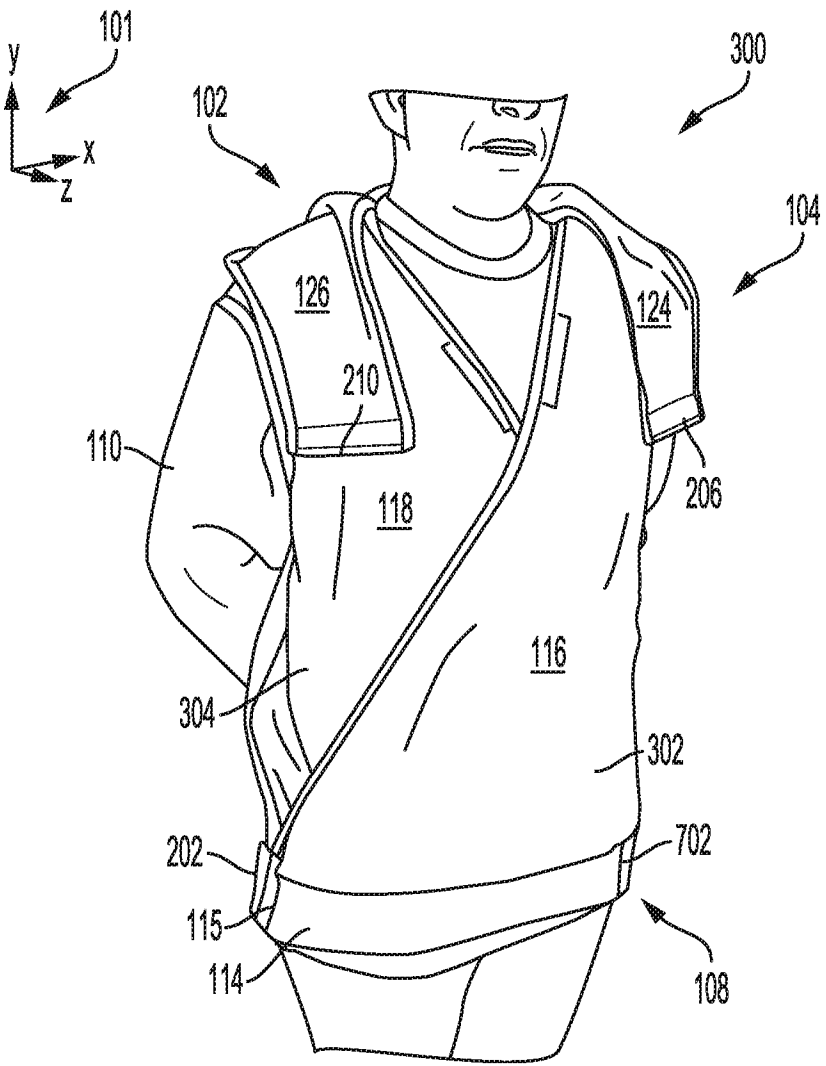
FIG. 3 shows a perspective view of the adaptive article of clothing with the main body section in the first worn configuration and the hood pulled away from the head of the wearer.

The first end 115 of the first front tail panel 116 may have at least one of a first half 202 of a second fastening device 204, as shown in FIG. 2 and FIG. 3. A perspective view 300 of the garment 102 is shown in FIG. 3, illustrating an arrangement of the first half 202 of the second fastening device 204 along an outer surface 302 of the first front tail panel 116 at the first end 115. The first half 202 of the second fastening device 204 is also disposed on the inner surface 502 (as shown in FIG. 2) of the first front tail panel 116 at the first end 115, placed opposite of the first half 202 of the second fastening device 204 attached to the outer surface 302 of the first front tail panel 116. The second end 117 of the second front tail panel 118 may be similar configured with the first half 202 of the second fastening device 204 coupled to both the inner surface 602 of the second front tail panel 118 and an outer surface 304, as shown in FIG. 3, of the second front tail panel 118.

The first half 202 of the second fastening device 204 may be similar to the first half 504 of the first fastening device, as shown in FIG. 5, formed of a strip of material extending along the y-axis. The first half 202 of the second fastening device 204 may include a plurality of discs 203, as shown in a zoomed-in view 700 in FIG. 7 of the second fastening device 204 at the hip region 108 of the left side of the wearer is shown in FIG. 7. More than one of a second half 702 of the second fastening device 204 may be coupled to both an outer surface 704 of the hem 114 at the left side of the wearer and an inner surface 802 of the hem 114, as shown in FIG. 8. A zoomed-in view 800 of the right side of the garment 102 at the hip region 108 is depicted in FIG. 8. Each of the more than one of the second half 702 of the second fastening device 204 may be formed of a strip of material extending along the y-axis, having a plurality of discs 703. Each strip of material is arranged parallel to and spaced away from adjacent strips of material. The second half 702 of the second fastening device 204 may be similar to the second half 508 of the first fastening device 506, adapted to engage with the first half 202 of the second fastening device 204.

Thus, when the garment 102 is arranged in the first worn configuration shown in FIG. 1 with the second front tail panel 118 crossed over the first front tail panel 116, the first half 202 of the second fastening device 204 on the inner surface 602 of the second front tail panel 118 at the second end 117 may be coupled to one of the more than one second half 702 of the second fastening device 204 on the outer surface 704 of the hem 114 at the left side of the wearer, as shown in FIG. 7. The first half 202 of the second fastening device 204 at an outer surface 302 of the first end 115 of the first front tail panel 116 may be coupled to one of the more than one second half 702 of the second fastening device 204 on the inner surface 802 of the hem 114 at the right side of the wearer, as shown in FIG. 8. The coupling of the halves of the second fastening device 204 at the first end 115 of the first front tail panel 116 and at the second end 117 of the second front tail panel 118, maintained the first and second front tail panels 116, 118, at least partially wrapped around the front of the wearer.

As shown in FIG. 8, the more than one of the second half 702 of the second fastening device 204 may be arranged in parallel along the hem 114 of the garment, spaced evenly apart. By providing more than one of the second half 702 of the second fastening device 204, a snugness of the garment 102 around the wearer at the hip region 108 may be adjusted. For example, coupling the first half 202 of the second fastening device 204 at the first end 115 of the first front tail panel 116 to a first strip 702*a* of the more than one of the second half 702 of the second fastening device 204 may wrap the garment 102 around the wearer with a first amount of tightness. When the first half 202 of the second fastening device 204 is coupled to a second strip 702*b* of the more than one of the second half 702 of the second fastening device 204, the garment 102 is wrapped around the wearer with a second amount of tightness that is less than the first amount. Similarly, coupling the first half 202 of the second fastening device 204 to a third strip 702*c* of the more than one of the second half 702 of the second fastening device 204 results in wrapping of the garment 102 around the wearer with a third amount of tightness that is less than the second or first amount. Coupling of the first half 202 of the second fastening device 204 to the more than one of the second half 702 of the second fastening device 204 at the left side of the hip region 108 of the wearer may be similarly varied to adjust a snugness of the wrapping of the second front tail panel 118 around the wearer.

Furthermore, the overlapping of the first front tail panel 116 and the second front tail panel 118 in the first worn configuration may be oppositely arranged so that the first front tail panel 116 is positioned over the second front tail panel 118 so that the second front tail panel 118 is closer to the wearer than the first front tail panel 116, as shown in FIG. 3. In this arrangement, the first half 202 of the second fastening device 204 on the inner surface 502 of the first end 115 of the first front tail panel 116 may be coupled to one of the more than one of the second half 702 of the second fastening device 204 on the outer surface 704 of the hem at the right side of the wearer. The first half 202 of the second fastening device 204 on the outer surface 304 of the second end 117 of the second front tail panel 118 may be coupled to one of the more than one of the second half 702 of the second fastening device 204 on the inner surface 802 of the hem 114 at the left side of the wearer.

While the first fastening device 506 at both the first shoulder region 106*a* and the second shoulder region 106*b* of the garment 102 is shown in an engaged orientation in the first worn configuration of FIG. 1, the first half 504 may be detached from the second half 508 of the first fastening device 506 at one or both of the first and second shoulder regions 106*a*, 106*b*, without disengaging the second fastening device 204 at the right side and/or left side of the wearer. For example, as shown in FIG. 5, the first half 504 of the first fastening device 506 of the first front tail panel 116 may be decoupled from the second half 508 of the of the first fastening device 506 at the second shoulder region 106*b*, while the first fastening device 506 at the first shoulder region 106*a* is maintained engaged. Additionally, the second fastening device 204 at the right side and the second fastening device 204 at the left side of the wearer are also maintained attached. The garment 102 is thereby opened at the second shoulder region 106*b*, allowing access to the left side of the wearer's torso.

An analogous but opposite configuration of the garment 102 is shown in FIG. 6, relative to the configuration shown in FIG. 5. Therein, the first half 405 of the first fastening device 506 of the second front tail panel 118 is detached from the second half 508 of the first fastening device 506 at the first shoulder region 106*a*. The first fastening device 506 at the second shoulder region 106*b*, the second fastening device 204 at the right side, and the second fastening device 204 at the left side of the wearer are all maintained engaged. The garment 102 is thereby opened at the first shoulder region 106*a*, allowing access to the right side of the wearer's torso.

Returning to FIG. 1, the first worn configuration of the garment 102 includes covering the head of the wearer with the hood 109. The hood 109 has a first neck flap 124 positioned at a bottom left region of the hood 109, and a second neck flap 126 positioned at a bottom right region of the hood 109. The first neck flap 124 and the second neck flap 126 may be crossed along a front of a neck of the wearer so that the neck flaps overlap. The first neck flap 124 may be crossed over the second neck flap 126 or, alternatively, the second neck flap 126 may be crossed over the first neck flap 124, as shown in FIG. 1.

The first neck flap 124 and the second neck flap 126 may each be rectangular flaps extending away from a base of the hood 109 from opposite sides of the hood 109 along a same direction. For example, each of the first and second neck flaps 124, 126 may hang parallel with one another and spaced away from one another when an end 206 of the first neck flap 124 is detached from the second front tail panel 118 and an end 210 of the second neck flap 126 is detached from the first front tail panel 116, as shown in FIGS. 2 and 3. As such, the neck flaps may hang downwards from the shoulder region 106 of the garment 102 along the front of the wearer.

The hood 109 may be attached to the back panel 906 as shown in FIG. 13 in a second rear view 1300 of the garment 102 at a collar 1302 of the back panel 906, similar to the collar 1406 of the back panel 1400 shown in FIG. 14. As illustrated in FIG. 13, the hood 109 may be coupled to the collar 1302 along a first seam 1304. The hood 109 may be formed of two halves, joined together by a second seam 1306 and forming a curved surface that accommodates a shape of the wearer's head and allows the hood 109 to surround a back and sides of the head without covering the wearer's face. Both the first seam 1304 and the second seam 1306 may be constructed from a type of stitching, as described above.

The first neck flap 124 may be secured to the second front tail panel 118 by a third fastening device 130. The third fastening device 130 may be similar to the third fastening device 506 and the second fastening device 204, having a first half (not shown in FIG. 1) of the first fastening device 130 attached to an outer surface 132 of the hood 109 proximate to the end 206 of the first neck flap 124, the end 206 of the first neck flap 124 shown in FIG. 2. The first half of the third fastening device 130 may be configured to engage with a second half 208 of the third fastening device 130 attached to the inner surface 602 of the second front tail panel 118 along the second inner edge 122 of the second front tail panel 118, as shown in FIG. 2.

The second neck flap 126 may also be secured to the first front tail panel 116 by the third fastening device 130. The first half of the third fastening device 130 (not shown) may be attached to the outer surface 132 of the hood 109, proximate to the end 210 of the second neck flap 126, as shown in FIG. 2. The second half 208 of the third fastening device 130 is coupled to the inner surface 502 of the first front tail panel 116, along the first inner edge 120.

The first fastening device 506 at the shoulder region 106, e.g., both the first shoulder region 106*a* and the second shoulder region 106*b*, may be maintained engaged while the second fastening device 204 at both the left side and the right side of the hip region 108, as well as the third fastening device 130 of the garment 102 at a neck region of the wearer, may all be decoupled when the garment 102 is arranged in a second worn configuration shown in FIG. 2. In the second worn configuration of FIG. 2, the main body section 104 of the garment 102 is allowed to hang open so that the first front tail panel 116 hangs downward, along the y-axis, from the second shoulder region 106*b* and the second front tail panel 118 hang downward, along the y-axis from the first shoulder region 106*a*. The first front tail panel 116 and the second front tail panel 118 are spaced away from one another and not in contact.

Figure 4:
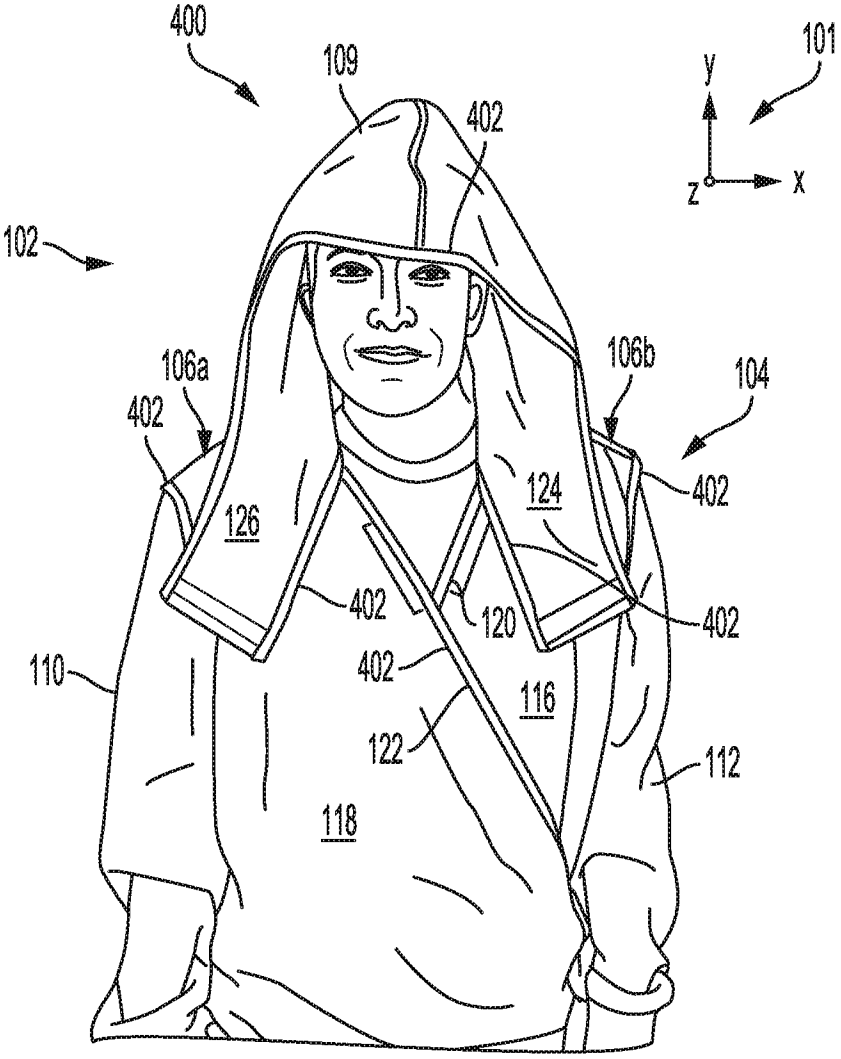
FIG. 4 shows a third front view of the adaptive article of clothing with the main body section in the first worn configuration and the hood covering the head of the wearer with the neck flaps unfastened.

The hood 109 is shown covering the wearer's head in the first worn configuration shown in FIG. 1 and removed from the wearer's head in the second worn configuration shown in FIG. 2. When removed from the wearer's head, the hood 109 may hang downwards, along the y-axis, from the collar 1302 of the back panel 906 of the garment 102, as shown in FIG. 12 in a first rear view 1200 of the garment 102. In other examples, however, the hood 109 may be removed from the wearer's head when the garment 102 is in the first worn configuration, as shown in FIG. 3, or the hood 109 may be covering the wearer's head while the garment is in the second worn configuration. In another example, the garment 102 may be in the first worn configuration and the hood 109 may be covered the wearer's head but the first neck flap 124 may be detached from the second front tail panel 118 and the second neck flap 126 may be detached from the first front tail panel 116, as shown in FIG. 4 in a third front view 400 of the garment 102. In yet another example one of the first neck flap 124 or the second neck flap 126 may be detached from the corresponding front tail panel while the other neck flap is attached while the garment 102 is in the first worn configuration. In addition, one or more of the first front tail panel 116 and the second front tail panel 118 may be opened, e.g., detached and hanging downwards and away from the wearer, at the shoulder region 106 when the garment 102 is in either the first worn configuration or the second worn configuration.

By configuring the garment 102 with fastening devices at certain regions of the garment 102, the wearer is provided with a plurality of configurations for how the garment 102 may be worn. For example, the tightness of the garment 102 at the hip region 108 may be adjusted by selecting the engagement of the first half 202 of the second fastening device 204 with the more than one of the second half 702 of the second fastening device 204 at the hem 114 of the garment 102. An accessibility of the wearer's torso may be adjusted by selectively attached or detached the first fastening device 506 arranged at the top portions of the first front tail panel 116 and the second front tail panel 118. The hood 109 may be worn covering the wearer's head or pulled away from the head regardless of whether the garment 102 is in the first worn configuration or the second worn configuration. Similarly, the first and second neck flaps may be attached to or detached from the inner edges of the front tail panels whether the hood is covering the wearer's head or not. Thus numerous modes for wearing the garment 102 are possible.

When worn in the first worn configuration, the garment 102 may wrap at least partially across the front of the wearer, providing the wearer with warmth and a swaddling effect that may be adjusted, e.g., by varying the engagement of the second fastening device 204. The overlapping of the first front tail panel 116 and the second front tail panel 118 without use of any fastening devices along the front side of the wearer to couple the front tail panels to one another may allow the front torso region of the wearer to be accessed through the overlapping region of the first front tail panel 116 and the second front tail panel 118, in one example. Increased accessibility is provided by detaching the first fastening device at each of the first shoulder region 106*a* and the second shoulder region 106*b* and allowing the front tail panels to be pivoted away from the wearer to hang down along the front side of the wearer.

When the garment 102 is worn in the second worn configuration, the front side of the wearer is readily accessible through the space between the first front tail panel 116 and the second front tail panel 118, both front tail panels draping along a left side and a right side of the front side of the wearer. In one example, the second worn configuration of the garment 102 may reduce the warmth and swaddling effect of the garment 102. In some instances the second worn configuration may be a transitional position between the wearing the garment 102 in the first worn configuration and removing the garment or between donning the garment 102 and adjusting the garment 102 to the first worn configuration.

Figure 10:
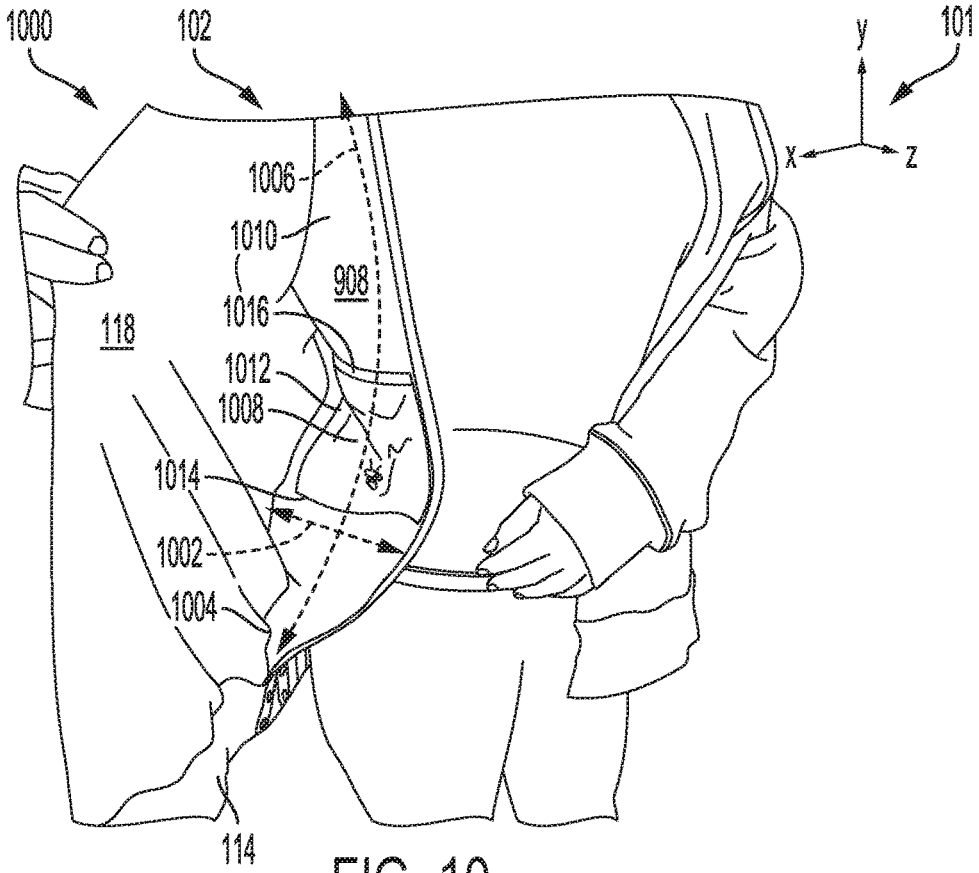
FIG. 10 shows a view of a first inner panel of the adaptive article of clothing.
Figure 11:
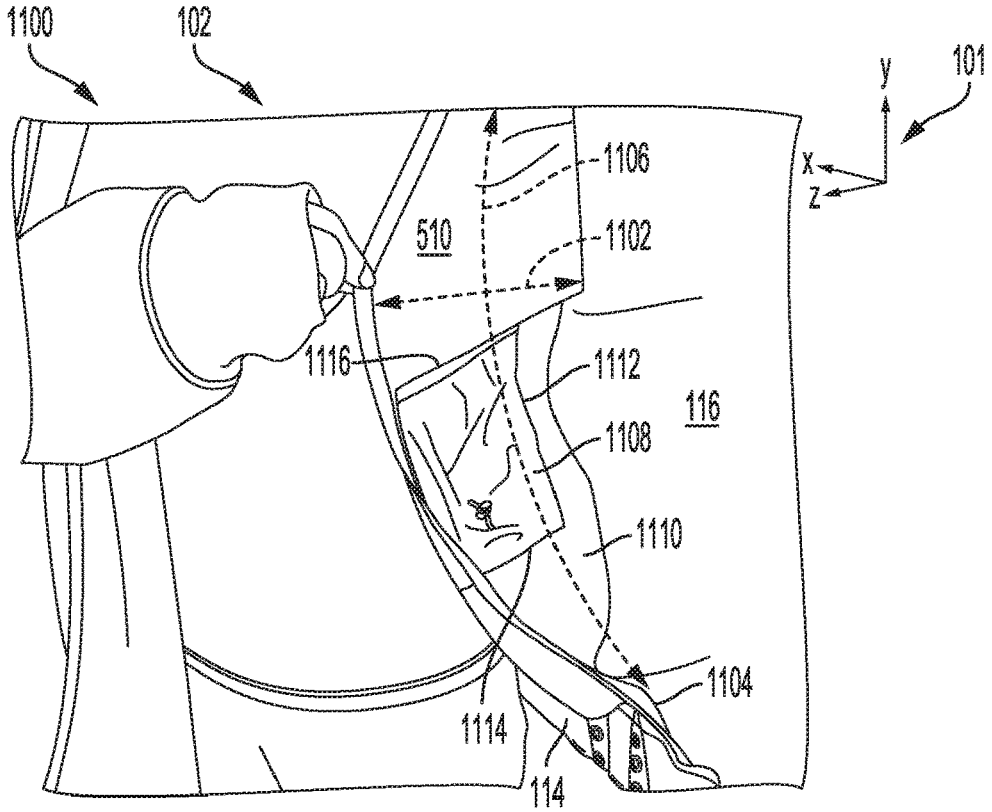
FIG. 11 shows a view of a second inner panel of the adaptive article of clothing.
Figure 12:
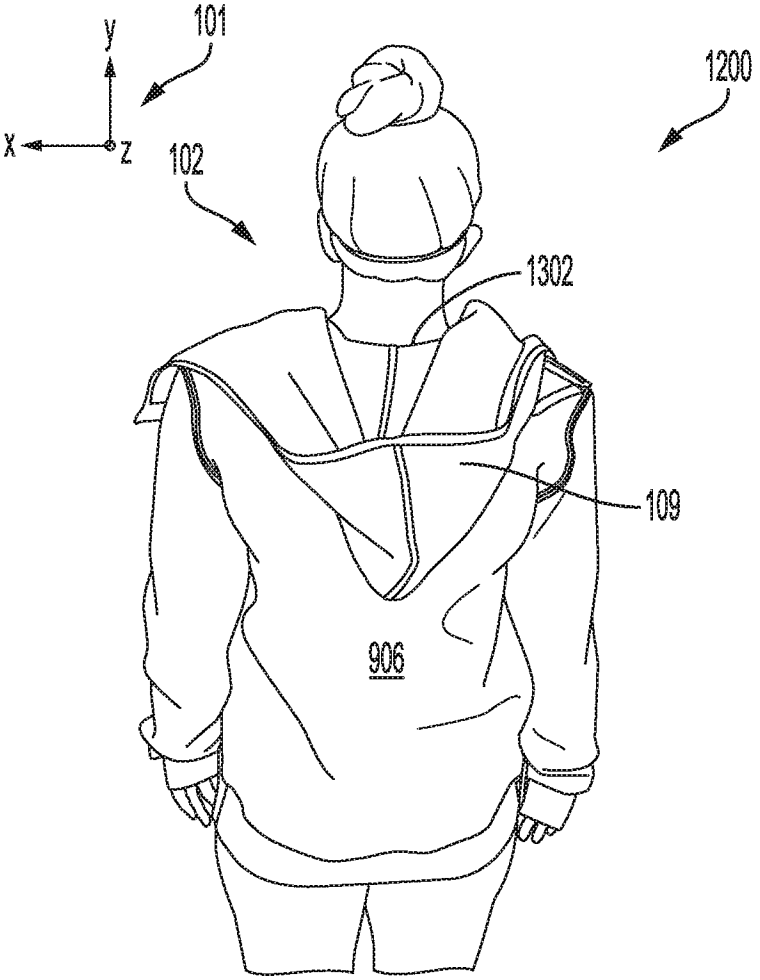
FIG. 12 shows a first rear view of the adaptive article of clothing with the hood pulled away from the wearer's head.

The garment 102 may further include the first inner panel 510 arranged inside of the first front tail panel 116, as shown in FIGS. 5 and 11, and the second inner panel 908, as shown in FIGS. 9 and 10. A view 1000 of the second inner panel 908 is depicted in FIG. 10 and a view 1100 of the first inner panel 510 is illustrated in FIG. 11. The first inner panel 510 forms a strip of material along the left side of the wearer, with a length 1106 of the first inner panel 510 arranged parallel with the y-axis, and extends a distance 1102 along the x-axis across the front of the wearer, as shown in FIG. 11. The first inner panel 510 may be attached to the back panel 906 and to the first front tail panel 116 along a linear portion along a side edge of the back panel 906, at a left side of the back panel 906. For example, the first inner panel 510 may be stitched to the seam extending along the linear portion 1426 of the first side edge 1412 of the back panel 1400 of FIG. 14 and extending along the lower portion 1516 of the side edge 1510 of the front tail panel 1500 of FIG. 15. A bottom edge 1104 of the first inner panel 510 may be attached to an upper edge of the hem 114, via, for example, stitching as described above.

The second inner panel 908 is similarly attached to the back panel 906 and the second front tail panel 118, as shown in FIG. 10. The second inner panel 908 may be coupled to a seam interfacing a side edge of the back panel 906 at the right side of the wearer with a side edge of the second front tail panel 118. A bottom edge 1004 of the second inner panel 908 may be coupled to the upper edge of the hem 114 by stitching. The second inner panel 908 may form a strip of material along the right side of the wearer, a length 1006 of the second inner panel 908 arranged parallel with the y-axis, and extends a distance 1002 along the x-axis across the front of the wearer.

The first inner panel 510 may include a first pocket 1108 coupled to an outer surface 1110 of the first inner panel 510, as shown in FIG. 11. As an example, the first pocket 1108 may be formed of a flexible material that is different from a material of the first inner panel 510. For example, the first pocket 1108 may be formed from a more durable, less elastic material than the first inner panel 510 to support insertion of an object into the first pocket 1108. Side edges 1112 and a bottom edge 1114 of the first pocket 1108 may be attached to the first inner panel 510 by, for example, stitching. An upper edge 1116 of the first pocket 1108, however, is not coupled to the first inner panel 510, providing an opening to an inner volume of the first pocket 1108. In this way, an object or device, such as a portable chemotherapy bag or a breast-feeding pump, may be placed inside of the first pocket 1108 and transported in the first pocket 1108 while the garment 102 is worn by the wearer.

In one example, the upper edge 1116 may include an elastic integrated into the upper edge 1116 so that the opening to the first pocket 1108 may be stretched and enlarged to more easily accommodate insertion of the object or device. In another example, the upper edge 1116 may be adapted with a cord or bungee and a cord lock, such as a toggle stopper. The cord lock may be used to tighten and shrink the opening of the first pocket 1108 or expand the opening, depending on a size of the object or device.

The second inner panel 908 may have a second pocket 1008 coupled to an outer surface 1010 of the second inner panel 908. Side edges 1012 and a bottom edge 1014 of the second pocket 1008 may be attached to the second inner panel 908 by, for example, stitching. Similar to the first pocket 1108, an upper edge 1016 of the second pocket 1008, is not coupled to the second inner panel 908, providing an opening to an inner volume of the second pocket 1008. An object or device, as described above, may be inserted into the second pocket 1008 through the opening at the upper edge 1016. The second pocket 1008 may be similarly configured and formed from a same material as the first pocket 1108, having a mechanism for adjusting the size of the opening at the upper edge 1016 by incorporating, for example, an elastic cord and/or a cord stop.

By coupling the first pocket 1108 and the second pocket 1008 to the first inner panel 510 and the second inner panel 908, respectively, the first pocket 1108 may be hidden from view by the first front tail panel 116 and the second pocket 1008 may be hidden from view by the second front tail panel 118. For example, when the garment 102 is worn in the first worn configuration, as shown in FIG. 1, the first pocket 1108 and second pocket 1008 are completely covered by the overlapping first front tail panel 116 and second front tail panel 118. When the garment is worn in the second worn configuration, as shown in FIG. 2, and the first front tail panel 116 and the second front tail panel 118 hang downwards from the shoulder region 106, forming a space between the front tail panels, the first pocket 1108 and the second pocket 1008 remain hidden by the hanging front tail panels. The first and second pockets 1108, 1008, thereby are maintained obscured from view by the front tail panels regardless of the garment 102 is worn, providing the wearer with privacy with regards to objects and devices inserted in the one or more of the first pocket 1108 and the second pocket 1008.

In addition to the elements of the garment 102 described above, the garment 102 may further include cuffs 140 arranged at an end of each of the first sleeve 110 and the second sleeve 112, as shown in FIG. 1. The cuffs 140 may, for example, be formed from a different material than the first sleeve 110 and the second sleeve 112, having more or less elasticity or having a greater or lesser thickness than the material of the sleeves. In one example, the cuffs 140 may be similar to a material of the hem 114, configured to encircle a region of the wearer more snugly than adjacent parts of the garment 102.

The garment 102 may also include piping along various edges of the garment 102. For example, piping 402 is shown in FIG. 4 along the first inner edge 120 of the first front tail panel 116 and along the second inner edge 122 of the second front tail panel 118. The piping 402 may also border an intersecting region of a top of the second sleeve 112 with the first front tail panel 116 at the second shoulder region 106*b* and an intersecting region of a top of the first sleeve 110 with the second front tail panel 118 at the first shoulder region

106*a*. Lower edges of the first neck flap 124 and the second neck flap 126 may be adapted with the piping 402 as well as upper edges of the neck flap, which continues to become an edge of the hood 109. The piping 402 may be formed of a different material than panels and sections of the garment 102, e.g., the front tail panels, the hood 109, the back panel 906, the sleeves, etc., and may, in some examples, provide structural support to edges of the garment 102 as well as aesthetic appeal. For example, the piping 402 may be a color that contrasts with a color of the garment 102.

In addition to coupling to edges of the garment 102, the piping 402 may also be used to form desired shapes and patterns along outer surfaces of the garment 102. As one example, the piping 402 may be attached to an outer surface of 1305 of the back panel 906 of the garment 102, as depicted in FIG. 13, to form a V, or chevron 1308, across an upper region of the back panel 906. The chevron may span across an entire width of the upper region of the back panel 906, extending from behind the first shoulder region 106*a* to behind the second shoulder region 106*b*. A point 1310 of the chevron 1308, formed of the piping 402, may be lower along the y-axis than ends of the chevron 1308 at the first and second shoulder regions 106*a*, 106*b*. The point 1310 of the chevron 1308 may be centered along a width of the back panel, the width defined along the x-axis.

In some examples, a material of the various panels and sections of the garment 102 may be formed from a soft, insulating, woven material, such as fleece. The fleece may be a polyester fabric, for example, or the garment 102 may be formed from a natural material such as cotton, as another example. The material of the garment 102 may have a targeted amount of elasticity and may further be lightweight, breathable, and moisture-wicking, in some examples.

In this way, an adaptive article of clothing may be readily donned or removed without demanding extension of a wearer's arms above the wearer's head or away from the wearer's torso. When ends of a first front tail panel and a second front tail panel, the first and second front panels configured as tapered, triangular sections, of the adaptive article of clothing are detached from the article of clothing at ends of each front tail panel, the wearer may insert the wearer's arms into sleeves of the adaptive article of clothing. The wearer may slide the article of clothing over the wearer's shoulders without extending or lifting the wearer's arms above the wearer's head. In addition, the article of clothing does not demand pulling an opening of the article of clothing over the wearer's head. The first front tail panel and the second front tail panel may be at least partially wrapped around a front of the wearer along opposite directions and attached to a hem of the article clothing at each of the tapered end points of the front tail panels. As such, the first front tail panel and the second front tail panel overlap and a snugness of the wrapping of the adaptive article of clothing around the wearer may be adjusted by fastening devices coupling the ends of the front tail panels to the hem. The front tail panels may be detached at a shoulder region, e.g., both a left shoulder and a right shoulder, of the wearer, to enable access to the wearer's torso, even while the ends of the front tail panels are attached to the hem. The adaptive article of clothing may also include a hood, attached to an upper edge of a back panel of the adaptive article of clothing. The hood may have a set of neck flaps, where ends of the neck flaps are configured to detachably couple to the front tail panels along inner edges of the front tail panels when covering of the wearer's neck is desired. The adaptive article of clothing may have inner panels, positioned behind the front tail panels, the inner panels adapted with pockets. By positioning the inner panels and pockets behind the front tail panels, the pockets, and contents of the pockets, may be hidden from view but readily accessed through a front region of the adaptive article of clothing.

In one example, an adaptive article of clothing comprises a first front tail panel and a second front tail panel configured to overlap while wrapping at least partially around a front of a wearer in opposite directions in a first worn configuration and hang open in a second worn configuration, wherein a top portion of at least one of the first front tail panel and the second front tail panel is detachably coupled in a shoulder region of the adaptive article of clothing to enable access to the wearer while the adaptive article of clothing is worn in each of the first worn configuration and the second worn configuration. A first example of the adaptive article of clothing further comprises a hood attached to an upper region of a back panel of the adaptive article of clothing, wherein the back panel is fixedly coupled at a first side of the back panel to the first front tail panel and fixedly coupled at a second side of the back panel to the second front tail panel, the first side of the back panel and the second side of the back panel both perpendicular to the upper region of the back panel. A second example of the adaptive article of clothing, optionally including the first example of the adaptive article of clothing, further includes wherein the hood has a first rectangular flap arranged above the first side of the back panel and configured to detachably couple to an inner edge of the second front tail panel below the shoulder region, and a second rectangular flap arranged above the second side of the back panel and configured to detachably couple to an inner edge of the first front tail panel below the shoulder region, and wherein the first rectangular flap and the second rectangular flap extend away from opposite sides of the hood along a same direction when ends of the first and second rectangular flaps are detached from the first front tail panel and the second front tail panel, the ends of the first and second rectangular flaps being distal to the hood. A third example of the adaptive article of clothing, optionally including one or more of the first and second examples of the adaptive article of clothing, further includes wherein the first rectangular flap and the second rectangular flap are configured to couple to the top portion of the second front tail panel and the top portion of the first front tail panel, respectively, when the adaptive article of clothing is in the first worn configuration. A fourth example of the adaptive article of clothing, optionally including one or more of the first through third examples of the adaptive article of clothing, further includes wherein the first rectangular flap and the second rectangular flap are configured to overlap when coupled to the top portion of the second front tail panel and the top portion of the first front tail panel, respectively. A fifth example of the adaptive article of clothing, optionally including one or more of the first through fourth examples of the adaptive article of clothing, further includes wherein when in the second worn configuration, the first front tail panel and the second front tail panel are each configured to detach from an upper edge of the back panel and open outwards, away from the wearer, and hang downwards from the first side and the second side, respectively, of the back panel. A sixth example of the adaptive article of clothing, optionally including one or more of the first through fifth examples of the adaptive article of clothing, further includes wherein when in the first worn configuration, the first front tail panel extends diagonally downwards across the front of the wearer from the shoulder region proximate to the first side of the back panel to a waist region at the second side of the back panel and the second front tail panel extends diagonally downward across the front of the wearer from the shoulder region proximate to the second side of the back panel to the waist region at the first side of the back panel. A seventh example of the adaptive article of clothing, optionally including one or more of the first through sixth examples of the adaptive article of clothing, further comprises a first sleeve fixedly coupled to the first side of the back panel above the first front tail panel and a second sleeve fixedly coupled to the second side of the back panel above the second front tail panel. An eighth example of the adaptive article of clothing, optionally including one or more of the first through seventh examples of the adaptive article of clothing, further comprises a first inner panel fixedly coupled to the first side of the back panel and arranged inside of the first front tail panel and a second inner panel fixedly coupled to the second side of the back panel and arranged inside of the second front tail panel.

In another example, an apparel item comprises a first tapered section configured to wrap across a front of a wearer along a first direction and detach from a first shoulder region of the apparel item, a second tapered section configured to wrap across the front of the wearer along a second direction, overlap with the first tapered section, and detach from a second shoulder region of the apparel item, the second direction being opposite to the first direction, a back panel configured to be positioned along a back of the wearer and coupled at a first side to the first tapered section and at a second side to the second tapered section, a first inner panel coupled to the first side of the back panel and positioned inside of the first tapered section, a second inner panel coupled to the second side of the back panel and positioned inside of the second tapered section, and a hood attached to an upper region of the back panel, the hood having a set of flaps configured to be positioned at a neck of the wearer and configured to detachably couple to each of the first tapered section and the second tapered section. A first example of the apparel item further includes wherein at least a portion of the first tapered section is triangular and, at a point of the triangular portion of the first tapered section, a mechanism of a first half of a first fastening device is coupled to an inner surface of the first tapered section, and wherein at least a portion of the second tapered section is triangular and, at a point of the triangular portion of the second tapered section, a mechanism of a first half of a second fastening device is coupled to an inner surface of the second tapered section. A second example of the apparel item, optionally including the first example of the apparel item, further comprises a hem fixedly coupled to a bottom edge of the back panel, a bottom edge of the first tapered section, and a bottom edge of the second tapered section, the hem including a mechanism of a second half of the first fastening device arranged along an outer surface of the hem below the second side of the back panel, the mechanism of the second half of the first fastening device configured to mate with the mechanism of the first half of the first fastening device, and a mechanism of a second half of the second fastening device arranged along the outer surface of the hem below the first side of the back panel, the mechanism of the second half of the second fastening device configured to mate with the mechanism of the first half of the second fastening device. A third example of the apparel item, optionally including one or more of the first and second examples of the apparel item, further comprises more than one mechanism of the second half of the first fastening device arranged in series along the outer surface of the hem below the second side of the back panel, each of the more than one mechanism of the second half of the first fastening device configured to mate with the mechanism of the first half of the first fastening device, and more than one mechanism of the second half of the second fastening device arranged in series along the outer surface of the hem below the first side of the back panel, each of the more than one mechanism of the second half of the second fastening device configured to mate with the mechanism of the first half of the second fastening device. A fourth example of the apparel item, optionally including one or more of the first through third examples of the apparel item, further comprises a first half of a third fastening device attached to an inner surface of the first tapered section at a top edge of the first tapered section and a first half of a fourth fastening device attached to an inner surface of the second tapered section at a top edge of the second tapered section, wherein the top edges of the first tapered section and the second tapered section are positioned at the first shoulder region and the second shoulder region, respectively, of the apparel item. A fifth example of the apparel item, optionally including one or more of the first through fourth examples of the apparel item, further comprises a second half of the third fastening device attached to an upper edge of the back panel at the first shoulder region and a second half of the fourth fastening device attached to the upper edge of the back panel at the second shoulder region, wherein the second half of the third fastening device is configured to mate with the first half of the third fastening device and the second half of the fourth fastening device is configured to mate with the first half of the fourth fastening device. A sixth example of the apparel item, optionally including one or more of the first through fifth examples of the apparel item, further comprises a first inner pocket coupled to an outer surface of the first inner panel and a second inner pocket coupled to an outer surface of the second inner panel. A seventh example of the apparel item, optionally including one or more of the first through sixth examples of the apparel item, further includes wherein sizes of openings of the first inner pocket and the second inner pocket are adjustable.

In yet another example, an article of clothing comprises, in a first configuration, two overlapping, oppositely arranged tapered panels fixedly coupled to opposite sides of a back panel of the article of clothing, each of the tapered panels extending across a front of a torso of a wearer and detachably coupled to a shoulder region of the back panel and a bottom hem of the article of clothing, and, in a second configuration, at least one of the tapered panels is detached from the back panel at one or more of the shoulder region of the back panel and the bottom hem. A first example of the article of clothing further comprises a hood attached to an upper region of the back panel and having a set of flaps extending away from a base of the hood, wherein the set of flaps are configured to cross and overlap when ends of the set of flaps are coupled to upper edges of the tapered panels. A second example of the article of clothing, optionally including the first example of the article of clothing, further comprises piping along edges of the article of clothing and along an outer surface of the back panel, wherein the piping along the outer surface of the back panel forms a chevron across a width of the back panel.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An apparel item, comprising:

a first tapered section configured to wrap across a front of a wearer along a first direction and detach from a first shoulder region of the apparel item, wherein the first tapered section comprises a longer bottom edge, a shorter top edge relative to the longer bottom edge, and an inner edge that extends between the shorter top edge and the longer bottom edge;

a second tapered section configured to wrap across the front of the wearer along a second direction, overlap with the first tapered section, and detach from a second shoulder region of the apparel item, the second direction being opposite to the first direction, wherein the second tapered section comprises a longer bottom edge, a shorter top edge relative to the longer bottom edge, and an inner edge that extends between the shorter top edge and the longer bottom edge;

a back panel configured to be positioned along a back of the wearer and coupled at a first side to the first tapered section and at a second side to the second tapered section;

a first inner panel coupled partially to the first side of the back panel and partially to the first tapered section, such that the first inner panel is positioned inside of the first tapered section;

a second inner panel coupled partially to the second side of the back panel and partially to the first tapered section, such that the second inner panel is positioned inside of the second tapered section; and a hood attached to an upper region of the back panel, the hood having a first neck flap and a second neck flap configured to be positioned at a neck of the wearer and configured to crisscross and detachably couple to each of the first tapered section and the second tapered section, wherein each of the first neck flap and the second neck flap comprises two parallel edges and a terminal distal edge positioned intermediate the two parallel edges, and wherein the terminal distal edge comprises a first half of a releasable fastening device positioned adjacent to the terminal edge and configured to detachably connect to the first tapered section or the second tapered section.

2. The apparel item of claim 1, wherein the inner edge of the first tapered section comprises a mechanism of a first half of a first fastening device, and further wherein the inner edge of the second tapered section comprises a mechanism of a first half of a second fastening device.

3. The apparel item of claim 2, further comprising a hem fixedly coupled to a bottom edge of the back panel, the hem including a mechanism of a second half of the first fastening device arranged along an outer surface of the hem below the second side of the back panel, the mechanism of the second half of the first fastening device configured to mate with the mechanism of the first half of the first fastening device, and a mechanism of a second half of the second fastening device arranged along the outer surface of the hem below the first side of the back panel, the mechanism of the second half of the second fastening device configured to mate with the mechanism of the first half of the second fastening device.

4. The apparel item of claim 3, further comprising more than one mechanism of the second half of the first fastening device arranged in series along the outer surface of the hem below the second side of the back panel, each of the more than one mechanism of the second half of the first fastening device configured to mate with the mechanism of the first half of the first fastening device, and more than one mechanism of the second half of the second fastening device arranged in series along the outer surface of the hem below the first side of the back panel, each of the more than one mechanism of the second half of the second fastening device configured to mate with the mechanism of the first half of the second fastening device.

5. The apparel item of claim 4, further comprising a first half of a third fastening device attached to an inner surface of the first tapered section at the shorter top edge of the first tapered section and a first half of a fourth fastening device attached to an inner surface of the second tapered section at the shorter top edge of the second tapered section, wherein the shorter top edge of the first tapered section and the shorter top edge of the second tapered section are positioned at the first shoulder region and the second shoulder region, respectively, of the apparel item.

6. The apparel item of claim 5, further comprising a second half of the third fastening device attached to an upper edge of the back panel at the first shoulder region and a second half of the fourth fastening device attached to the upper edge of the back panel at the second shoulder region and wherein the second half of the third fastening device is configured to mate with the first half of the third fastening device and the second half of the fourth fastening device is configured to mate with the first half of the fourth fastening device.

7. The apparel item of claim 1, further comprising a first inner pocket coupled to an outer surface of the first inner panel and a second inner pocket coupled to an outer surface of the second inner panel.

8. The apparel item of claim 7, wherein sizes of openings of the first inner pocket and the second inner pocket are adjustable.

9. The article of clothing of claim 1, wherein the inner edge of the first tapered section tapers towards the longer bottom edge of the first tapered section to define a taper of the first tapered section.

* * * * *